US005857787A

United States Patent [19]

Ryan

[11] Patent Number: 5,857,787

[45] Date of Patent: Jan. 12, 1999

[54] PRINTER AND MOTOR HAVING A BALANCED BUCK DRIVE

[75] Inventor: Robert P. Ryan, Mission Viejo, Calif.

[73] Assignee: Prinntronix, Inc., Irvine, Calif.

[21] Appl. No.: 712,175

[22] Filed: Sep. 11, 1996

[51] Int. Cl.[6] ..... B41J 19/00

[52] U.S. Cl. ..... 400/322; 400/903; 101/93.15

[58] Field of Search ..... 101/93.03, 93.15, 101/93.16; 400/320, 322, 323, 903

[56] References Cited

U.S. PATENT DOCUMENTS

| | | | |
|---|---|---|---|
| 3,941,051 | 3/1976 | Barrus et al. | 101/93.04 |
| 4,463,300 | 7/1984 | Mayne et al. | 318/687 |
| 4,498,793 | 2/1985 | Barrus et al. | 400/320 |
| 4,749,294 | 6/1988 | Barrus et al. | 400/322 |
| 4,854,756 | 8/1989 | McCrimmon, Jr. et al. | 400/322 |

FOREIGN PATENT DOCUMENTS

| | | | |
|---|---|---|---|
| 116412 | 5/1993 | Japan | 400/320 |
| 124287 | 5/1993 | Japan | 400/320 |

*Primary Examiner*—Ren Yan
*Assistant Examiner*—Steven S. Kelly
*Attorney, Agent, or Firm*—George F. Bethel; Patience K. Bethel

[57] ABSTRACT

A dot matrix printer and motor having hammers forming in part a hammerbank and a counterbalance mechanically linked to the hammerbank with a link to the position of the motor. The motor includes coils positively driven and then negatively driven after current in the coils has at least partially decayed. The current in the coils is allowed to decay further after negatively driving the coil. The motor coils are connected to an H bridge having transistors which can be formed in a full H bridge or half bridge. A controller switches the transistors to cause negative and positive flow through the H bridge for positive current flow from a reference level to an upper reference level, and a decay of current within the coils to an intermediate reference. The coils are then driven with a negative current from the intermediate reference level to a second intermediate reference level afterwhich the current within the coils decays to a lower or initial reference level.

18 Claims, 11 Drawing Sheets

FIG. 6
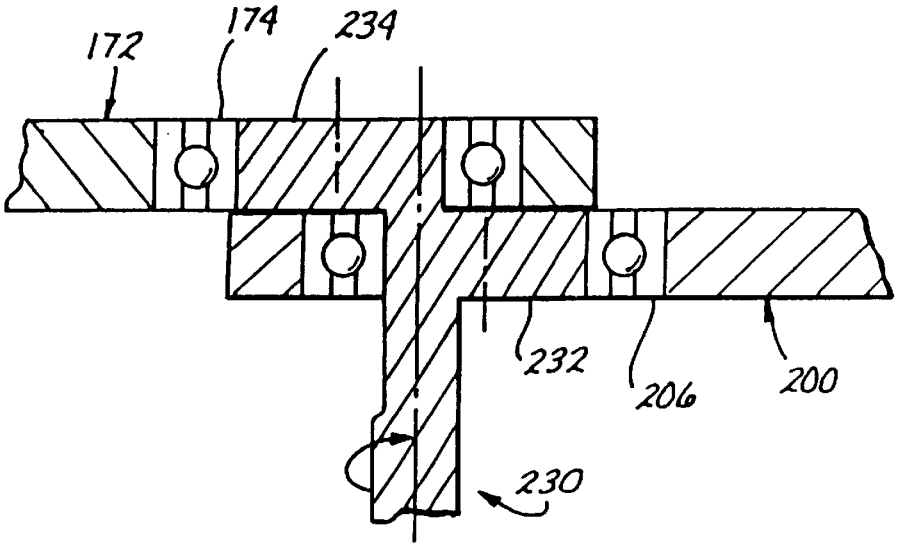
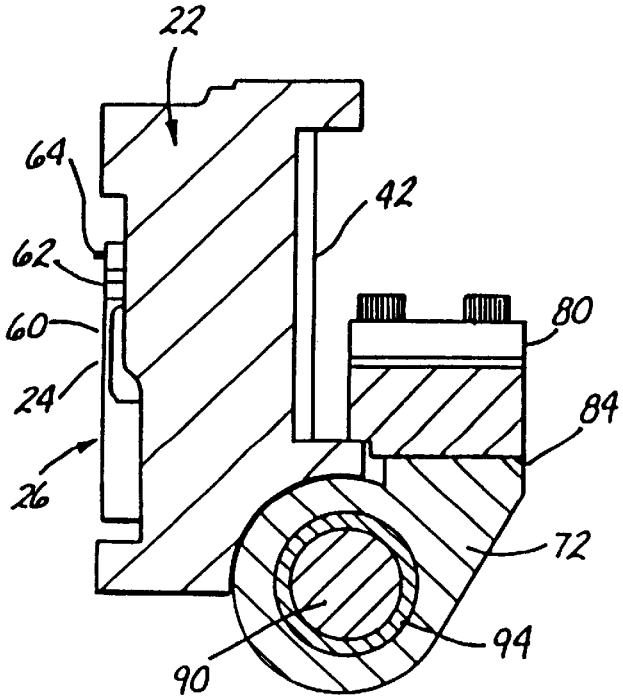
FIG. 7

THREE PHASE BRUSLESS D.C. MOTOR IMPLEMENTATION

PRINTER AND MOTOR HAVING A BALANCED BUCK DRIVE

BACKGROUND OF THE INVENTION

1. Field of the Invention

The field of this invention lies within the printer and motor art. More particularly, it lies within the art of dot matrix printing wherein numerous dots are printed on a print media such as a sheet of paper to provide for an alpha numeric representation thereon. It also resides in the field of motor controls for brushless D.C. motors, D.C. brush motors and D.C. stepping motors. It specifically can relate to the field wherein line printers are driven by motors for movement across a print media in order to impress a number of dots thereon as the printer moves reciprocally across the print media. It also includes motor drives and controls for the various motors used with or analogous to the foregoing mentioned motors.

2. Prior Art and Improvements Thereover

The prior art with regard to dot matrix printers encompasses multiple printers of various configurations. Such configurations use various wheels and hammers of various types to impress a dot on a print media. One particular type of printer which is known in the art is a line printer.

Line printers generally have a series of hammers. The series of hammers are implaced on a hammerbank which reciprocally moves across a print media. The print media is advanced across the hammers and is printed thereon by an inked ribbon.

Such hammers are supported on a hammerbank. The hammers are often held in place by a permanent magnet until released or fired. The release or firing takes place by the permanent magnetism holding the print hammers being overcome.

In the past, it has been known to place a drive motor at a location to drive the hammerbank reciprocally by a crank or a connector. The crank or connector moves the hammerbank in a reciprocal manner in a sufficiently rapid manner so as to provide high speed printing.

A problem of the prior art is that the motor was not always consistently driven to provide for smooth and effective printing movement. The motors were driven in a buck mode, or a push pull mode, which was not always desirable.

A drawback of the prior art with regard to motor drives for both printers and various motors is that they were driven in either a buck drive mode or a push pull mode.

The buck drive had a low ripple current which improved efficiency. However, it could not decrease output current on demand. This made it very difficult for use with linear controls in order to cause the motor to function in a manner where demands were made of the type in printers and certain other motor uses.

The push pull motor drives create and decrease current on demand. Nevertheless, they suffer from high ripple current hence there is less efficiency. The push pull convertor drives the motor positively until a reference is reached. The bridge driving the motor is then reversed and the current is driven negatively until the next cycle beings. The deceleration or reduction of current in a push pull design is linear and controlled. However, it has extremely high ripple currents and it also dumps excess motor energy back to the supply. This requires extra circuits in the power system to dissipate the stored energy in the motor.

It is an object of this invention to provide a balanced buck drive. This fundamentally operates like two convertors complimenting each other.

The object is to provide this balanced buck so that the first part of the cycle drives until a positive reference is reached. Thereafter, as driven through the second part of the cycle and decreasing the current with back emf, the system continues through a third intermediate cycle and a fourth cycle making an improved balanced buck.

The balanced buck drive provides an object of this invention by maintaining a current comparable to the buck style drive. However, it is responsive to requests for more or less current within each switching cycle.

A further object to the invention is that the balanced buck drive of this motor control dissipates excess motor energy in the motor windings and not in the power system or control circuits.

Another object is that the balanced buck drive provides for more consistent printing by having smoother motor operation and a limitation of ripple currents that affect motor operation and attendant print quality.

The balanced buck drive of this invention enhances the drive of a printer motor, as well as motors in general such as brushless D.C. motors of the printer of this invention, D.C. brush motors, and D.C. stepping motors.

The objects of this invention are not only to drive the printer of this invention but also to broadly apply the applicable principles and invention hereof to other types of motors.

Another object of this invention which is significant is that the motor, counterbalance and hammerbank are keyed or linked for operation after being placed in a closed loop relationship. This effectively allows an electrically locked position between the motor and the hammerbank. This is effectuated by means of a single sensor that merely senses the position of the rotor of the motor that is in turn keyed to the position of the hammerbank.

For these reasons, the invention is a substantial step over the prior art and enhances line printer functions as well as smoothness of operation, speed of operation, and provides longevity and finer printing for a line printer than had previously been capable in the art. It also provides enhanced control of brushless D.C. motors, D.C. brush motors and D.C. stepper motors in general.

SUMMARY OF THE INVENTION

In summation, this invention comprises a line printer with a motor for driving the printer having a balanced buck drive which is also applicable to other types of motors.

More particularly, the invention comprises an improved line printer having an integral hammerbank with an overlying or surrounding counterbalance interconnected thereto. An integrated motor and flywheel are provided to the invention. The flywheel is on the outside of a circular magnetic ring which overlies a stator for causing the flywheel to move on an integrated basis with the motor shaft connected thereto through the stator.

This invention in reference to the movement of the motor eliminates redundant sensors by detecting the rotor position using a variable reluctance magnetic position sensor. The elimination of the multiple sensors in the motor itself eliminates the expensive Hall sensors and the need for multiple sensors. The sensor can also be in the form of other magnetic, optical, or other types of sensors that sense the position of the rotor of the motor.

In order to enhance the use of a single sensor, extreme accuracy is maintained and orientation of the sensed pulses that are a direct correlation to the position of the rotor as it is connected to the hammerbank. In turn, the hammerbank must be in position with respect to the motor so that the sensor that sends signals as to the position of the rotor of the motor is directly correlated and oriented with the position of the hammerbank.

The entire system is controlled by a host and a central processing unit by detecting movements of the motor rotor as correlated to the hammerbank, causing the system to respond thereto so that the integral unit moves in a smooth, accurately positioned, and low vibration printing movement.

Of great significance is the fact that this invention uses a motor drive that operates in a balanced buck mode. It is believed that this is new with regard to both printers of this type and motor drives analogous thereto. The balanced buck drive operates like two buck convertors complimenting each other.

The improvement is with regard to the cycle being broken into four parts. The first part of the cycle drives the motor until a positive reference is reached. Thereafter, the second part decreases current with back emf like a standard buck convertor.

In the third or intermediate part, the balanced buck drive of this invention drives negatively until a negative reference is reached. Finally, the fourth part decreases current with back EMF until the cycle repeats upon reset.

The balanced buck drive has a low ripple current effect comparable to the ripple current of the buck drive mode. However, it is responsive to requests for more or less current within each switching cycle. It dissipates excess motor energy in the motor windings and not the power system. The foregoing not only enhances the operation of the motor of this invention for a printer, but also motors of the type that would be considered to be a three phase brushless D.C. motor, a D.C. brush motor, or a D.C. stepping motor.

As a consequence of the foregoing, it is believed that this invention is a significant step over the art of both printers and motor drives analogous to the type of motors that are being used as set forth herein.

BRIEF DESCRIPTION OF THE DRAWINGS

FIG. 6 shows a view of the drive shaft with the eccentrics and bearings thereof as sectioned along lines 6—6 of FIG. 4.

FIG. 7 shows a side sectional view of the linear bearings, shafts and connectors related to the hammerbank as seen in the direction of lines 7—7 of FIG. 4.

DESCRIPTION OF THE PREFERRED EMBODIMENTS

Figure 1:
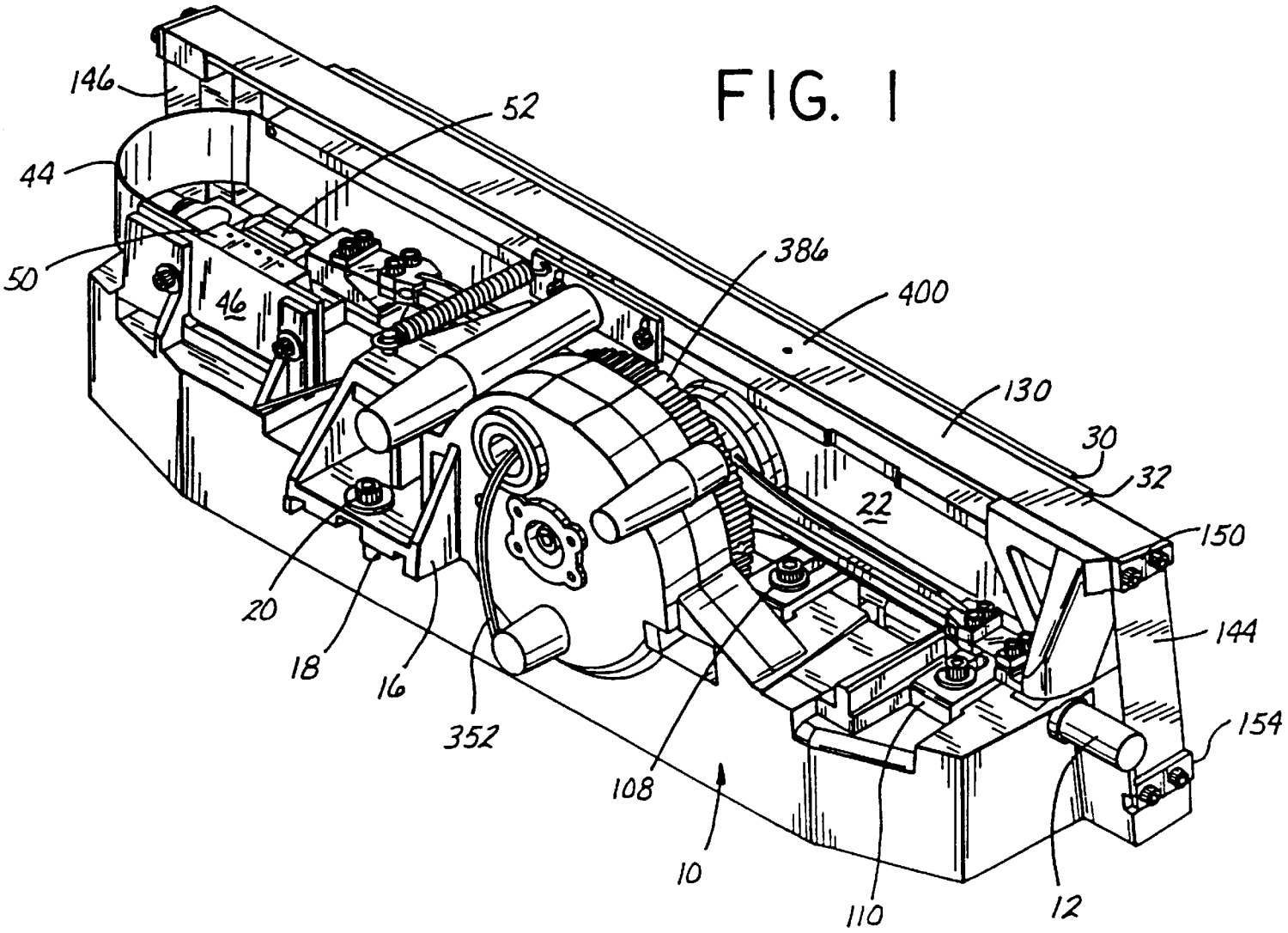
FIG. 1 shows a perspective view of the integrally driven and balanced line printer of this invention with its shuttle frame to be mounted on a mechanical base.
Figure 2:
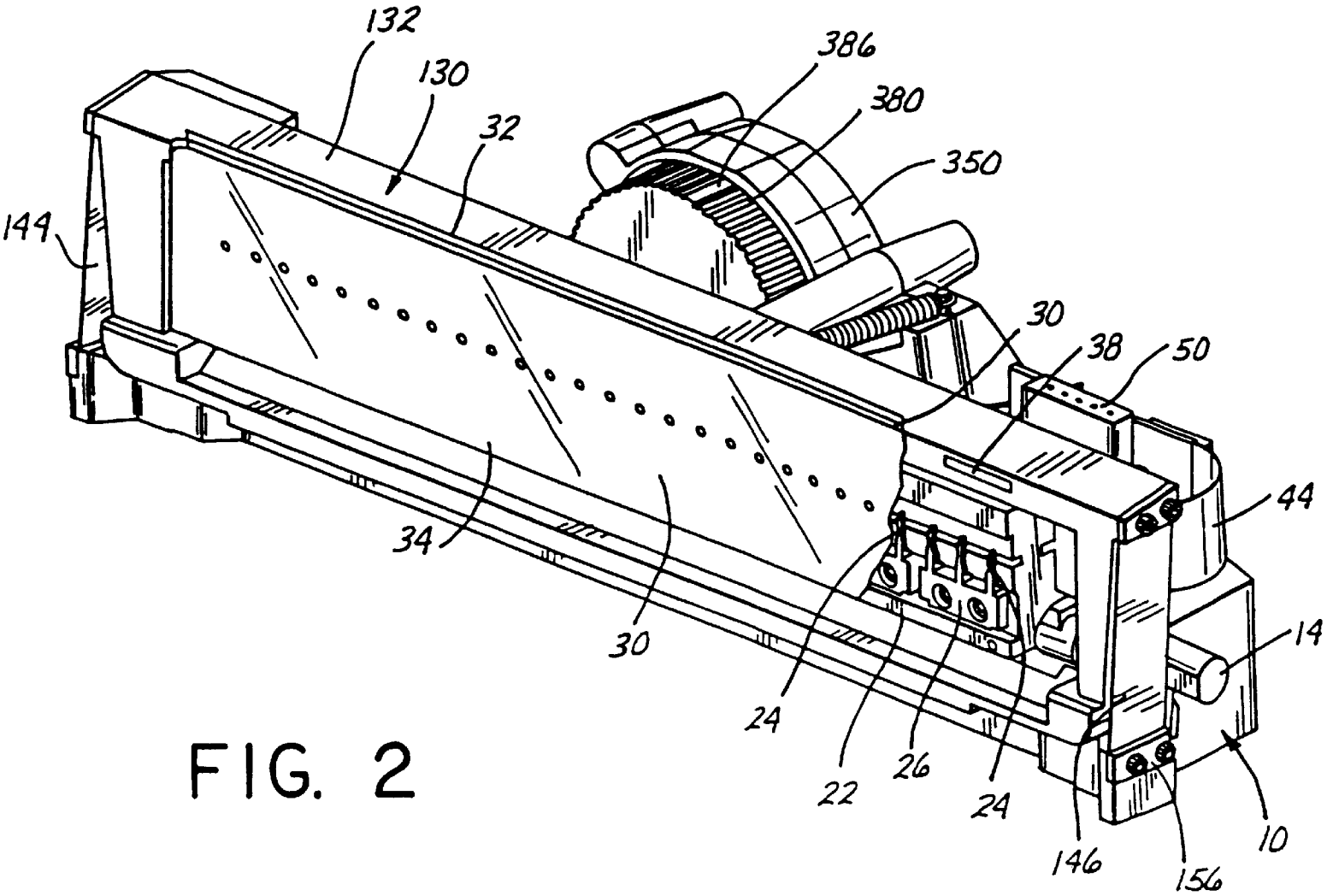
FIG. 2 shows a perspective view of the integrally driven and balanced line printer looking at the opposite side from that shown in FIG. 1, and wherein a fragmented portion of the hammerbank cover and ribbon cover have been removed to expose the hammers of the hammerbank.

Looking more particularly at FIGS. 1 and 2, it can be seen that a base 10 has been shown attached to a mechanical base and can form a portion of a cabinet or a stand. Underlying the base 10, are a series of cross members to provide reinforcement. The base 10 is mounted to a mechanical base by shafts 12 and 14 that can be rotated on the mechanical base. This allows the entire printer structure to be rotated such that the hammers can be adjusted with respect to a platen which they impinge on, by the mounting shafts 12 and 14 comprising two portions of a three part mounting. The third portion of the mounting is a bracket 16 integrally formed with the base 10 for maintaining it in rigid relationship with a mounting screw 18 having an allen head 20. Adjustment can be made by raising and lowering and adjusting the mounting screw FIG. 1 shows a hammerbank 22 of this invention from the back, while FIG. 2 shows the hammerbank with the hammers exposed and formed in a series of three, on frets 26 which are screwed to the hammerbank.

Each hammer 24 has a pin like member 64 that impacts against a ribbon against an underlying print media such as paper. The ribbon passes between a ribbon mask 30 and a hammerbank cover 32 which are held together and joined at bottom interface 34 secured by four magnets, one of which is shown as magnet 38.

A circuit board 42 with a plurality of electronic components drives the hammers 24 and is connected to a flex cable 44 that is in turn connected to a terminator board 46 for interconnection to a central and data processing unit. A power connection is provided in terminal block 50, while a logic connection is provided through a logic connector 52.

In FIG. 7, it can be seen that each hammer 24 has a neck portion 60 terminating in an enlarged portion 62 with a tip 64 at the end. The printed circuit board 42 which terminates at connection 44 provides the logic to electronic drive components to allow the hammers 24 to be fired.

Figure 4:
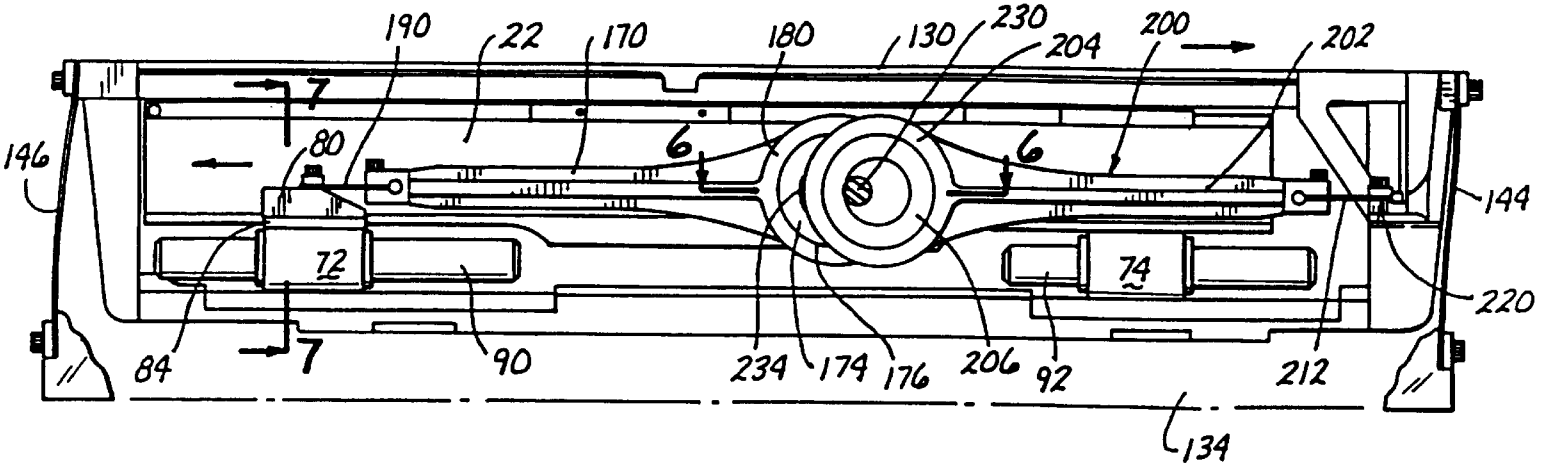
FIG. 4 shows a side elevation view of the connecting rods for respectively driving the hammerbank and counterbalance.
Figure 5:
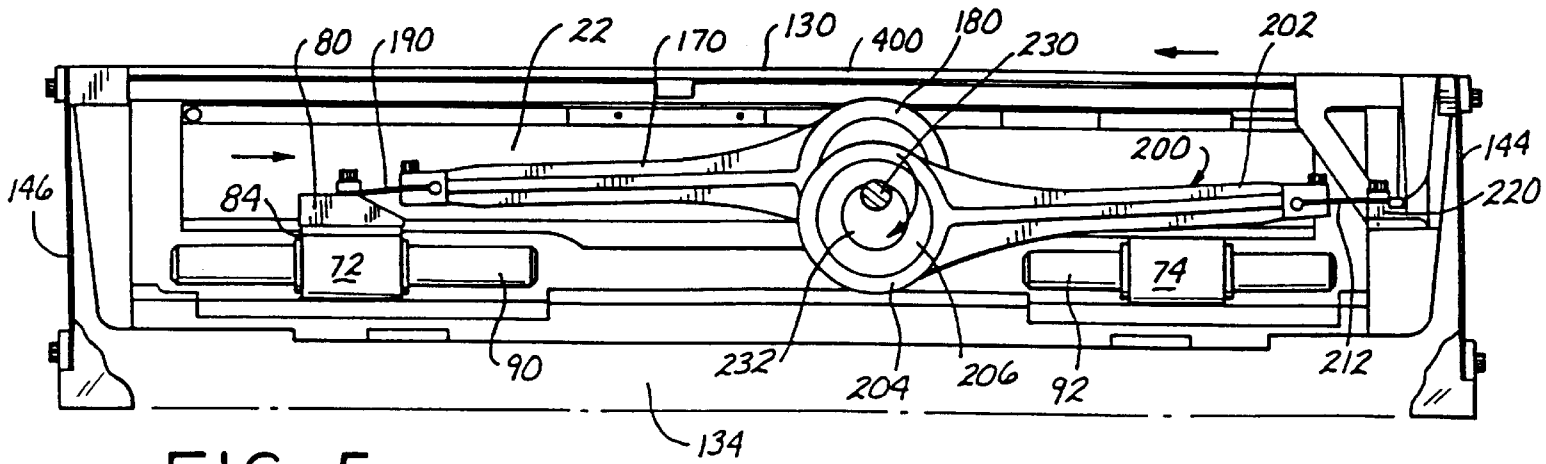
FIG. 5 shows a side elevation view of the respective hammerbank and counterbalance connecting rods driven 90° from the position shown in FIG. 4.
Figure 8:
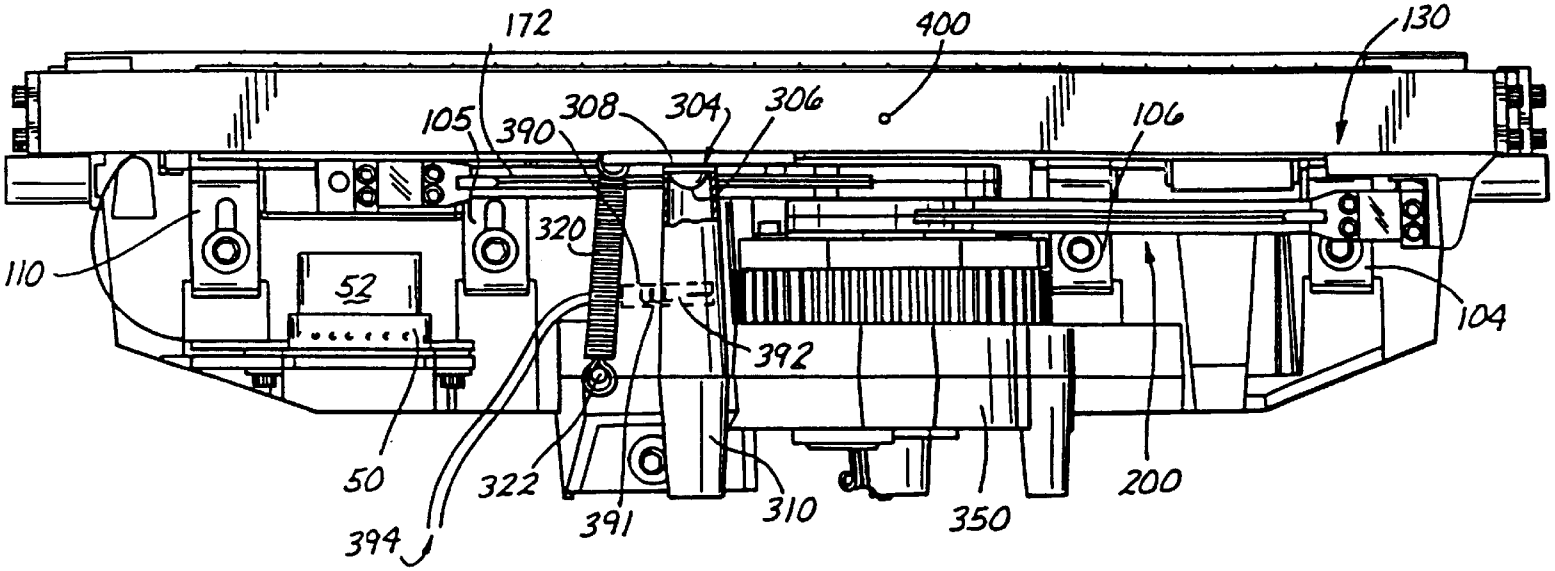
FIG. 8 comprises a top plan view looking downwardly at the printer of this invention.

The hammerbank 22 is secured for driving by two respective lugs, the driving lug 72 and the trailing lug 74 each respectively connected to a concave portion 76 of the hammerbank 22 by high strength glue. The driving lug 72 has a block driver 80 having a flat portion 84 as seen in FIGS. 4 and 5. The respective driving lug 72 and trailing lug 74 each have a shaft 90 and 92 passing therethrough to move reciprocally on the shafts and is supported with a linear bearing 94 shown in FIG. 7.

Figure 3:
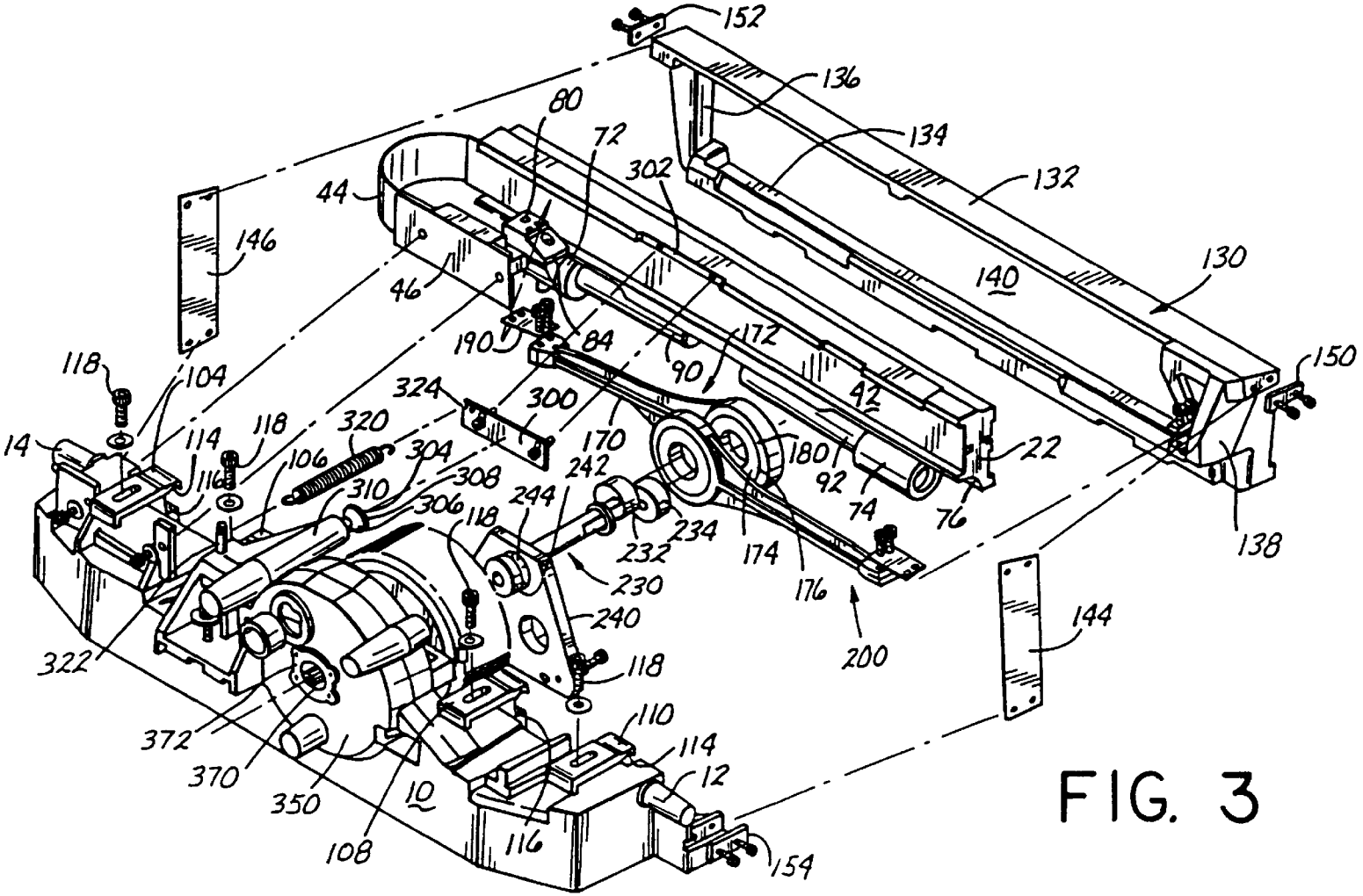
FIG. 3 shows an exploded view of the components of the integrally driven and balanced line printer shown in the same direction as that of FIG. 1.

The shafts 90 and 92 are secured to the base 10 by four clamps 104, 106, 108 and 110 seen in greater detail in FIG. 3 and incorporate a concave interior surface 114 to receive a portion of the shafts. They serve to clamp the shafts 90 and 92 against flats 116 seen in FIG. 4. These flats 116 secure the shafts 90 and 92 tightly against the base 10 and are secured by a screw and a washer 118 securing each clamp 104, 106, 108 and 110 and its attendant shaft.

A general rectangular configuration forms the counterbalance 130 surrounding the hammerbank 22 in part, and moves reciprocally and in opposite directions to the hammerbank 22. The counterbalance 130 is aligned for parallel movement with the hammerbank 22 in close proximate relationship, both of which can be collectively referred to as the shuttle. The counterbalance 130 is die cast forming a frame with upper member 132 and lower member 134. The ends of the counterbalance 130 are provided with upright portions 136 and 138 which roughly define a rectangular opening 140.

The counterbalance 130 is supported on the base 10 by flexures, or spring leaves 144 and 146 secured respectively to the base 10 by clamps 150 and 152 having screws with allen heads. The supports 144 and 146 allow for reciprocal movement of the counterbalance 130 in the direction of the length of the counterbalance. The counterbalance 130 support leaves are shown flexed in FIG. 4 in their driving motion.

The hammerbank 22 and the counterbalance 130 are driven by a first shaft, or drive rod 170 on a connecting rod or crank arm 172. The crank arm or rod 172 has a ball bearing 174 pressed fit with lock tight into an opening 176 provided by an opening 180 forming a portion of the crank arm or rod. The connecting rod 172 terminates at a rod spring flexure 190 screwed to the end of the connecting rod or crank arm. FIG. 4, shows the movement in a relatively aligned position while FIG. 5 shows it flexed.

A second crank arm or connecting rod 200 is shown having an elongated connection 202 with a looped opening 204 containing a ball bearing 206. The connecting rod 200 terminates in a rod flexure spring member 212 which is secured by screws to the counterbalance 130 at a clamp 220 held again by screws.

To drive the hammerbank 22 and counterbalance 130, the crank arms 172 and 200 are driven 180° offset from each other by a crank or shaft 230 having two integral offset eccentric circular portions. An eccentric 232 is associated with connector rod 200, and eccentric 234 is associated with crank arm or connector rod 172. These two respective eccentrics 232 and 234 move within the respective ball bearings 206 and 174.

In order to support the crank or shaft 230, a front support plate 240 is utilized having a bearing 242 inserted within an opening 244 for rotational movement. The crank or shaft 230 rotates around an axis established by the center of the crank or shaft 230 thereby causing the eccentric circular portions 232 and 234 to drive respectively crank arms or connecting rods 172 and 200 in a reciprocating manner 180° offset from each other. The foregoing movement can be seen in FIGS. 4 and 5.

As reciprocal movement is encountered, the hammerbank 22 can rotate around the axis of the shafts 90 and 92 to some extent. In order to prevent this rotation, an anti-rotation plate 300 is utilized and secured to the hammerbank 22 by two screws on the inset portion 302. The anti-rotation plate 300 provides a surface which can be held tightly against a button disk, or seating surface 304. The button disk, or seating surface 304 is a disk like member having a rounded or convex surface 306 and a flat portion or surface 308. The rounded portion 306 is seated within an anti-rotation boss member 310 having a convex rounded cup like seat to receive the disk. This allows the disk 304 to adjust its flat surface in relationship to the anti-rotation plate 300 so that the two flats are against each other.

The hammerbank 22 is biased against the anti-rotational plate 300 by a coil spring 320 secured to a pin 322 on the base 10 and through an opening 324 within the anti-rotational plate.

In order to rotate the crank or shaft 230, a brushless DC motor is utilized that is emplaced within a circular housing 350 with a portion exposed. The brushless D.C. motor is driven by three wire leads 352 connected to a circuit board 354 with terminals that distribute power to a stator 356. The stator 356 has a number of stator coils 358 that are connected to the circuit board terminals 354 so that stepped pulses can cause the motor to rotate.

Figure 10:
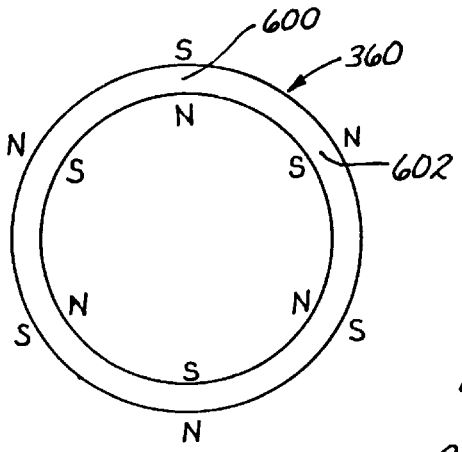
FIG. 10 shows a view of the relative placement of the magnetic portions of the circular magnet of the motor as to the north and south orientation of the magnetized portions of the ring.
Figure 11A:
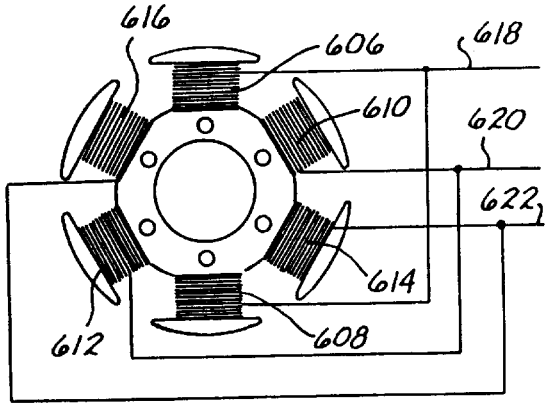
FIG. 11A shows the electrical connections for the various coils of the stator of the motor of this invention with alternative Y or Delta connections.
Figure 11B:
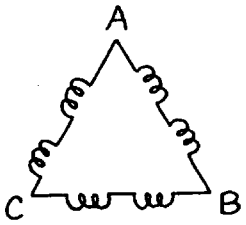
FIG. 11B shows the coils connected in a Delta configuration.
Figure 11D:
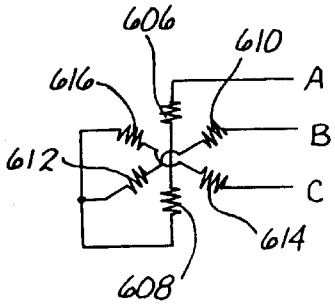
FIG. 11D shows the coils of the motor in the Y configuration with the coils 606 through 616 connected with terminals A, B and C analogous to terminals 618, 620, and 622.
Figure 11C:
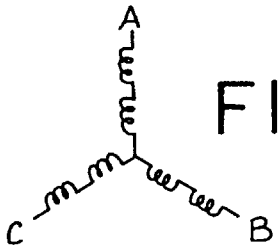
FIG. 11C shows the coils connected in a Y configuration.

The motor is an inside out type of motor with a ferrite magnetic ring 360 having north south polarities oriented in the manner shown in FIG. 10. The motor includes a flywheel portion 364 connected to the motor by emplacement the magnetic ring 360 both of which are referred to as the rotor.

The flywheel 364 has a flywheel shaft 366 with an opening 368 that receives the crank or shaft 230 passing therethrough, and is seated within an opening 370 of the base 10. The opening 370 has a retainer 372 and a bearing (not seen) which supports the flywheel shaft 366 in order to turn the crank or shaft 230.

The flywheel 364 has a plurality of teeth, notches, or lands and grooves respectively 380, and 382 around the surface thereof equally spaced except where an enlarged space or groove 386 can be seen in FIG. 1. This enlarged space or groove 386 can comprise the equivalent of two grooves 382, to allow for a detection of non-continuity of the lands and grooves 380 and 382. This permits telemetry of the orientation and speed of the flywheel 364 and the shaft with the attendantly oriented hammerbank 22 and counterbalance 130 (collectively the shuttle).

The lands and grooves 380 and 382 provide for detection of movement by a variable reluctance magnetic detector 390 having a permanent magnet 392 connected to leads 394. Every time a land 380 passes, the magnetic orientation between the permanent magnet 392 and a coil 391 causes a signal to be generated on leads 394.

The initial start-up of the printer with the shaft 230 turned by the motor causes it to rotate to approximately 250 to 300 rpm afterwhich the pickup pulse by the sensor 390 becomes more stable. The pickup pulse orients the flywheel 364 and drive with regard to the enlarged space, gap or groove 386.

Figure 9:
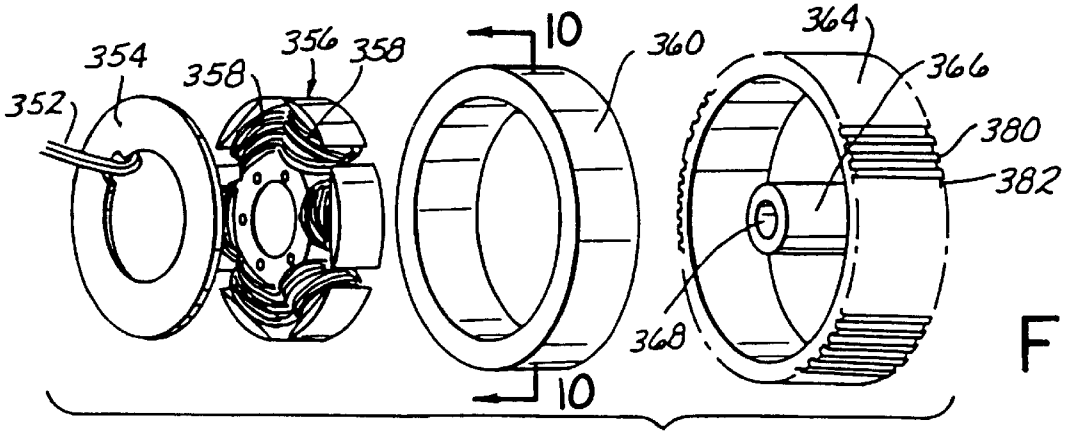
FIG. 9 shows an exploded view of the integrated motor and flywheel of this invention.

The motor as shown in FIGS. 9, 10, and 11 operates on an open loop basis until the proper timing is sensed. It then operates on a completely closed loop basis so that it moves in correspondence to the printing duty requirements.

Coils 356 are excited in a manner so that they respectively are tied together through their connections as seen in FIG. 11. In particular, the coils 358 can be seen as a first coil 606 connected with a second coil 608 one hundred and eighty degrees (180°) therefrom. A third coil 610 is connected to a fourth coil 612 that is in turn one hundred and eighty degrees (180°) from the coil 610. Finally, a fifth coil 614 and a sixth coil 616 are connected one hundred and eighty degrees (180°) apart. These respective connections can be seen as the connections, terminals or lines 618, 620, and 622 that comprise those connected to or forming lines 352. Coil is and shall be referred to as those coils or windings of a motor.

Looking at FIGS. 11A, 11B, 11C, and 11D it can be seen that a Y and Delta connection have been shown as alternatives. The connection of the coils and the Y and Delta configuration assume that the coils 606 through 616 are equivalent to those of the Y or Delta configuration except for the fact that they have been connected in the stator in the Y configuration enumerated with terminals A, B, and C which are equivalent to terminals 618, 620, and 622 or in the Delta configuration equivalent to both of the previous terminals. The Y configuration has been shown with coils in the same orientation as those of the detailed stator.

In effect, the Y or Delta configuration allows the motor to be driven with the invention hereof as will be expanded upon in the same manner as those coils of the detailed stator 606 through 616. The only difference is that they are connected differently and are accordingly energized in a different manner. However, it should be born in mind that the coils have been shown in multiple coil relationship in the Y or Delta configuration so that two coils in effect have been connected to terminals A, B, or C which are equivalent to terminals 618, 620, and 622. This allows an energization of the plural coils.

Generally stated, in order to effectuate controlled movement, the drive at the time of starting provides for a large amount of current through one of the motor coils, for example one of the pairs, such as pair 606 and 608 or their equivalent in the Y or Delta configurations. This causes the motor to rotate to a known position and stop. The shorting of the other two pairs of coils causes the motion to be dampened and helps remove oscillations. After holding the motor still for an instant, the current is driven through the next pair of coils, causing the motor to rotate. The stator in the form of the coils 356 commutate after startup at a faster rate. After the sensor 390 detects both the appropriate speed and position, then the drive changes from an open loop mode to a closed loop mode.

The balanced buck drive of this invention, which forms the heart of the inventive aspects as applied to both the motor of the printer of this invention which is a three phase brushless D.C. motor, also applies to other D.C. motors such as a D.C. brush motor and a D.C. stepping motor. The prior art with regard to driving such motors can be seen in FIGS. 12 and 13.

Figure 12:
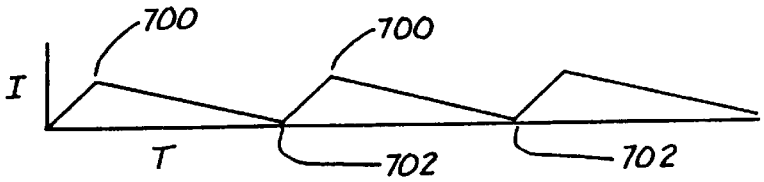
FIG. 12 PRIOR ART
FIG. 12 shows a graphical description of the buck drives of the prior art.

In FIG. 12, it can be seen that the prior art pertaining to a buck drive has been shown with regard to current (I) on one axis, and implementation, pulsing or conduction of current as to each respective coil along the time (T) axis.

If the coils such as those coils shown in FIG. 11 of the motor are initially energized in the buck configuration of the prior art shown in FIG. 12, the current (I) will ramp up to a given amount in order to drive a respective coil. For instance if the coils 606 through 616 are to be energized with a buck drive, the initial input of current (I) rises to an upper reference level such as level 700 and then begins to decrease. The rate of decrease in the current (I) is not controllable from the upper reference level 700 to the lower reference level 702.

The buck drive has low ripple current which improves efficiency but is not readily controllable. As can be understood ripple current in a motor winding creates excess heat and decreases the efficiency of the motor.

The drawback of the buck drive is that it cannot decrease output current (I) on demand. This makes it difficult to use linear control circuits. What the buck fundamentally does is drive positive until a reference is reached such as reference 700. The current then decreases into the next cycle down to current level 702. The motor back EMF determines the rate of current decrease.

Decelerating a motor or reducing the winding current when stepping or pulsing requires placing the buck in a brake state that is blind to excessive current, or switching the bridge into reverse. This causes a disruption of the control system and is not easily handled by a linear circuit.

Figure 13:
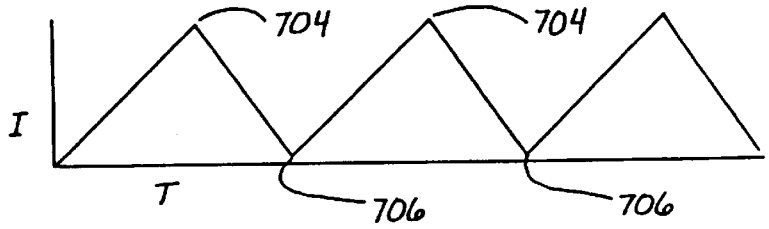
FIG. 13 PRIOR ART
FIG. 13 shows a graphical description of the push pull drives of the prior art.

Looking at FIG. 13, the effect of the push pull circuit on the coils can be seen with regard to the rise in current (I). The push pull circuitry can increase and decrease current on demand, but it suffers from high ripple current. This creates significant inefficiencies. The current graph of the push pull convertor as shown in FIG. 13 drives the current up to reference point 704 through the positive (P) push phase and then negatively (N) pulls it down to reference point 706 which is the lower reference. The reference voltage can be whatever is desired within the coils of the motor.

In order to go from reference point 704 to lower reference 706, the bridge is reversed and the current is driven negatively (N) until the next cycle begins. Decelerating or reducing the current in a push pull design is linearly controlled. However, because of the excess motor energy or current, this current is placed back onto the power source or supply. This can require extra circuits in the power system to dissipate the stored energy as the current is pulled from reference point 704 to reference point 706.

Figure 14:
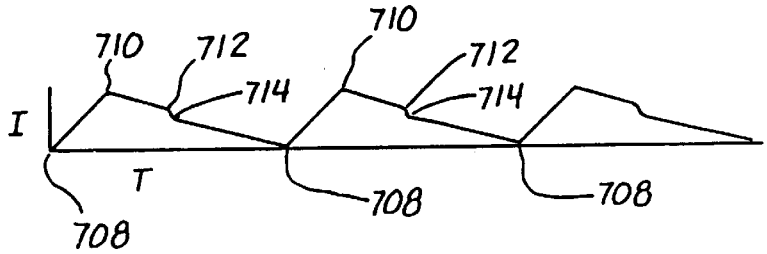
FIG. 14 shows a graphical description of the balanced buck drive of this invention.

The invention hereof, namely the balanced buck can be seen in FIG. 14. Summarily, this operates like two buck convertors complimenting each other. The cycle is broken into four parts. The first part of the cycle drives positively (P) from current reference point 708 to current reference level 710. After the positive (P) reference is reached at 710, a decrease or decay in the current (I) is allowed to take place near the second portion of the phase namely from reference point 710 to 712. This is basically like the buck convertor. However, from reference point 712 to 714 a third or intermediate phase is realized wherein the system of the invention drives negatively (N) until the desired negative reference is reached. Thereafter, the fourth phase going from reference point 714 to 716 decreases the current with back electromotive force (EMF) until the cycle repeats again from lower reference 708 to 710 and again through the second phase to 712 and the third or intermediate phase to 714 to the reference level 708.

If the demand for current change is large and one of the drive parts of the cycle does not terminate, it is allowed to continue until the reference 708 is reached. The complimentary positive (P) or negative (N) cycle is skipped if necessary.

The balanced buck drive as shown schematically in FIG. 14 is responsive to a request for more or less current within each switching cycle and dissipates excess motor energy in the motor winding and not the power system.

Figure 18:
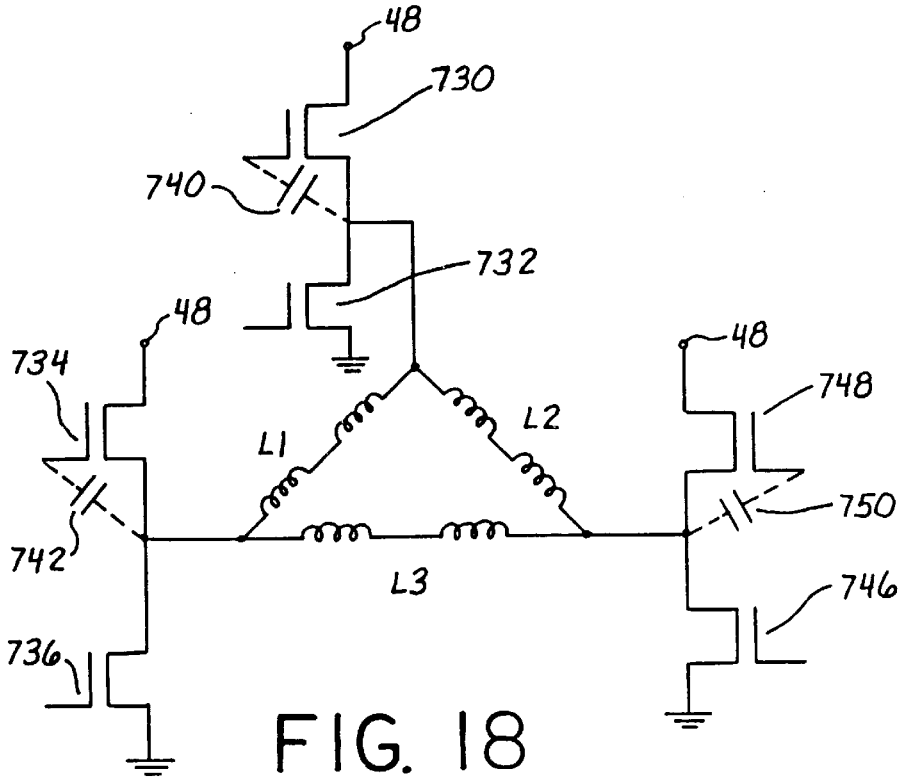
FIG. 18 shows the coils of the motor of this invention connected to the components of the H bridge.
Figure 17:
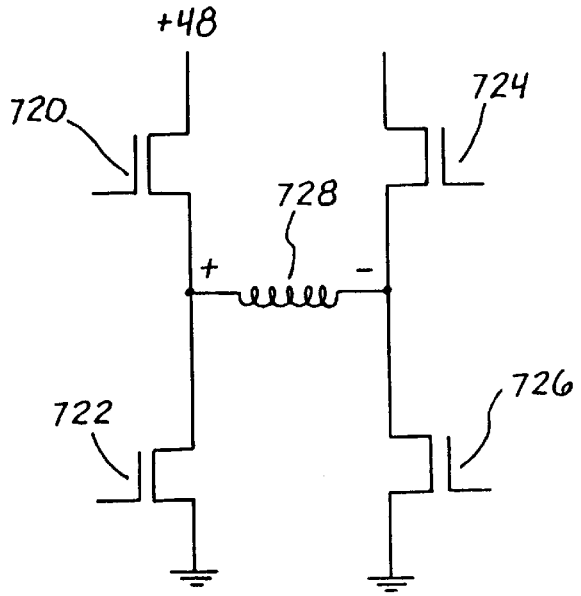
FIG. 17 shows an H bridge with a coil analogous to that being used in the motor of this invention.

The application of the foregoing balanced buck drive when implemented in the coils can be seen more specifically in the H bridge drive as shown in FIGS. 17 and 18.

For purposes of example of an H bridge drive, an H bridge in FIG. 17 is shown with mosfet field effect transistors (FET'S) 720, 722, 724 and 726. These FET switches or transistors in the bridge conduct or pulse current to a given coil such as coil 728 which would be analogous to the coils 606 through 618, or those in the Y or Delta configuration of the motor. For this particular example, coil 728, which would fundamentally be a combined coil of two coils of the motor winding, to be energized positively (P), requires FET 720 and 726 to be turned on. When positive drive is desired across a coil such as exemplary coil 728, the FET 720 along with FET 726 is turned on so that the current flows in the direction from positive (P) to negative (N).

When flow is desired in the opposite direction from the minus to the plus side of exemplary coil 728, FET 724 and FET 722 are turned on to allow flow in the other direction. In order to allow current flow to circulate, the two FETS 722 and 726 are turned on so that flow circulates and does not drive the coil in either direction.

Looking more specifically at FIG. 18 it can be seen that there is an implementation of the FETS with the coils L1, L2 and L3 that are equivalent to the coils of the motor windings respectively 606, 608, 610, 612, 614, and 616. Also, these coils L1, L2, and L3 are equivalent to those in the Y or Delta configuration such that the coils as configured would be similar as far as the FET drivers pertaining to those coils. Also, a split H bridge is used so that a full H bridge for the three coils L1, L2, and L3 is not required.

In order to implement the invention as shown in FIG. 18, FETS 730 and 732 are shown connected to coils L1, as well as FETS 734 and 736. When driving the coils positively, flow is through FETS 734 and 732 when they are switched on. When driving negatively, FETS 730 and 736 are switched on. When current demand is satisfied and minimal change is desired a recirculation mode is entered. Recirculation is accomplished by switching on FETS 736 and 732 or alternately for thermal sharing reasons FETS 734 and 730 can be used. In order to keep the two respective FETS current flowing for a prescribed period of time, capacitors 740 and 742 are utilized, and maintained with a charge.

If coils L2 are to be turned on, flow is from FET 730 to FET 746. If implementation of a negative drive is utilized, FET 748 is turned on as well as FET 732. Recirculation is accomplished by switching on FETS 732 and 746 or alternately FETS 730 and 748 can be used. In order to maintain the positive current flow, a capacitor 750 is shown utilized between the gate of FET 748 and the connection to coil L2 on which a charge is maintained.

In like manner, if coils L3 are to be provided with a positive current, FET 734 and 746 are switched on with maintenance of a charge on capacitor 742. If implementation of a negative current is required of coils L3, FETS 748 and 736 are turned on. Recirculation is accomplished by switching on FETS 746 and 736 or alternately FETS 748 and 734 can be used.

The foregoing generally shows the implementation of the turning on and off of the FETS to provide for the balanced buck action of FIG. 14. However, in order to turn the respective FETS on as shown in FIG. 18 for the H bridge responding to a particular coil, it is necessary to determine the state of the coils and control them through a system which in this case is a digital state machine. The state machine can be seen as outlined in a circular logic configuration and diagram of FIG. 15.

Figure 15:
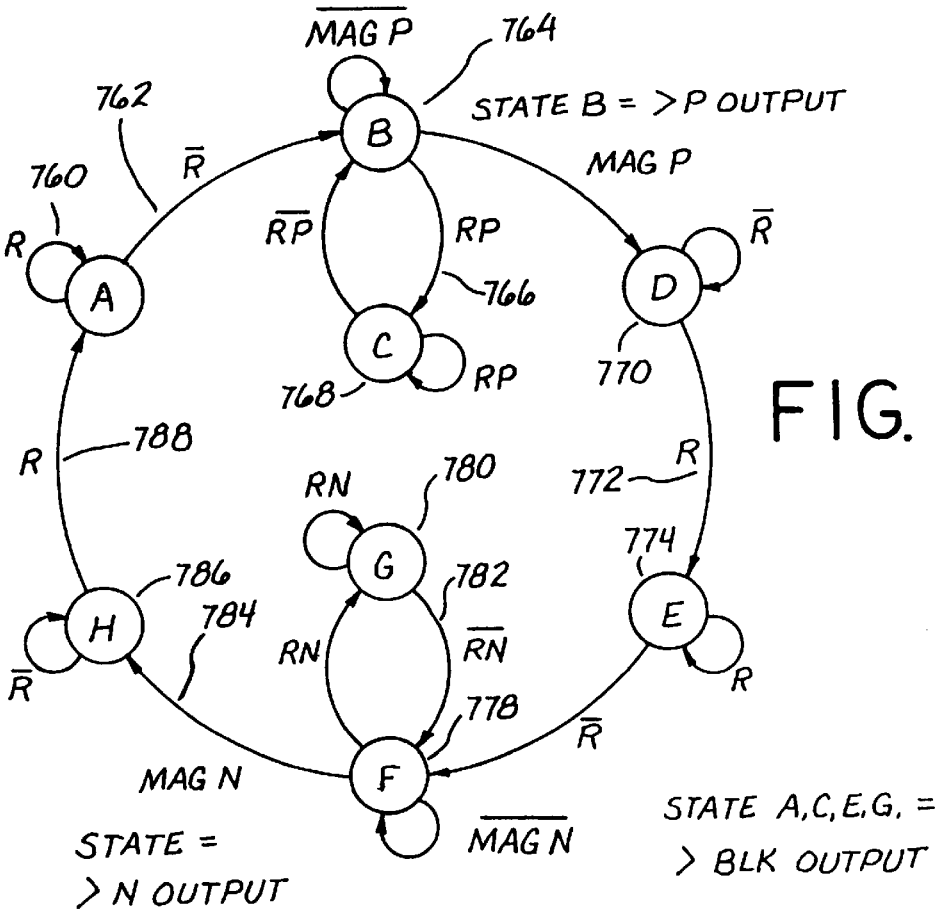
FIG. 15 shows the state machine controlling the balanced buck drive.

In general the state machine of FIG. 15 generates two system clocks 90° out of phase for timing. Two refresh signals are generated from a system clock 180° out of phase, one for positive time and one for negative time. A refresh is required for each upper or positive drive boot strap capacitor which has been shown as the upper drive capacitors 740, 742, and 750.

A global reset provides for the summation of these refresh signals. The state machine waits for a refresh, then begins a positive or negative cycle. For purposes of understanding the state machine of FIG. 15, it should be emphasized that it waits for a refresh, then begins a positive or negative cycle. For the purposes of looking at the state machine, it is assumed that a positive cycle is beginning. Therefore, the output state during refresh is P (positive or push equals zero) and N (negative or pull equals zero). During the positive cycle, P (push) will be one (1), and N (pull) will be zero (0). In effect, a positive drive P through the bridge is being implemented such as the bridge as previously stated for example in FIGS. 17 and 18.

The state machine will continue until the analog circuits equate that the current in a given coil is greater than the command or a positive P refresh is reached. When refresh is over, the positive P cycle continues. If the positive P current level is reached the state machine will terminate the positive P cycle and wait for the negative N refresh time of P (push equals zero) and N (pull equals zero). When a negative N refresh is completed, the negative cycle begins and the output is P (push equals zero) and N (pull equals one). The circuit again waits for an analog input reporting that the current is less than the command for a refresh thereafter. As an aside, the state machine also generates a blanking pulse for the analog circuit which prevents excessive disturbance and attempts to insure a clean start at the beginning of each positive or negative cycle.

Looking more specifically at the state machine of FIG. 15 with respect to the balanced buck including the showing of FIG. 14, the cycle of events for controlling the input to the coils can be seen. The inputs to the state machine are the analog comparators which constitute the magnitude of the push or positive pulse to the coils (MAG-P) and the magnitude of the pull or negative pulse to the coils (MAG-N). Also the timing signals are R (reset), RP (refresh positively), and RN (refresh negatively) as shown. The outputs are the P and N signals that control the output bridge as well be seen in the later figures.

The normal progression through the states of the machine are A, B, D, E, F and H. Timing pulses, RP, and RN and inputs MAG-P and MAG-N determine the rate of travel through the states with respect to the current reference values for the coils. The MAG-P and MAG-N comparators are blind unless the bridge is driving positively (state B) or negative (state F).

The controller sends a blanking pulse before a positive or negative cycle begins (state ACEG). The blanking pulse insures the current feedback amplifier is below the comparator's reference.

Two refresh signals RP and RN are generated from a system clock 180° out of phase. RP for positive time and RN for negative time. A refresh is required for upper drive boot strap capacitor maintenance such as those capacitors as shown in FIG. 18 namely capacitors 730, 742, and 750. If MAG-P or MAG-N do not complete before RP or RN, the machine will enter C or G to refresh the drive bridge capacitors 740, 742 and 750. After the refresh, the machine will continue to drive until MAG-P or MAG-N have been satisfied as to the appropriate reference levels. A global reset R is the summation of RP and RN. The state machine then waits for a reset and begins a positive P or negative N cycle.

For purposes of further explanation, please look at the state machine wherein a bar over a particular nomenclature is in reference to the fact that it does not exist or is not in that state. When looking at the reset A with respect to reset R which shall be designated point 760, it can be seen that the cycle is beginning and that there is no reset at 762. During the reset state 760 the capacitors are refreshed. At point 764, the positive cycle begins which is the initial reference level. This is when the coils are going to be driven positively as in the manner of going from point 708 for driving the coil positively as seen in FIG. 14. If the MAG-P signal is not satisfied by the time a refresh period is required, the refreshing of the capacitors such as those capacitors 730, 742 and 750 will take place at 768 commanded by the RP signal 766.

At state B where the output is equal to or greater than the positive P output, the magnitude of the positive refresh MAG-P continues to state D which is shown as point 770 in the cycle. At state D, a decay of the current is allowed with the back EMF. This is equivalent to point 710 of FIG. 14 wherein the decay of the current in the coil is occurring. At this point, due to the asynchronous nature of the MAG-P signal a full refresh cannot be guaranteed but reset R is being undertaken in the direction and through the cycle 772 until reset at point 774 is achieved. At point 774, the cycle waits until the reset signal terminates at 776 and ensures a full refresh.

At point 778, the negative cycle is beginning so that the state machine will drive the current in the negative direction. At this point, it can be seen that it is driving it in the direction of point 712 to 714 in the graphic example of FIG. 14. If the MAG-N signal is not satisfied by the time a refresh period is required, a refresh at state 780 will occur driven by RN 782.

The negative drive will continue until the MAG-N signal 784 is satisfied. Once MAG-N is satisfied, the current will be recirculating and decaying at a slow rate based on back EMF. Due to the asynchronous nature of MAG-N an additional guaranteed refresh period is generated between 786 and 780 based on reset 788. This constitutes decay of the current from point 714 to 708 of the graphical representation of the coil current in FIG. 14. Reset then begins at point 788 so that the cycle can then again begin at point 760 for providing the positive pulse necessary to go again from point 708 to point 710 of the implementation of energizing the coil as shown in FIG. 14.

Figures 16, 19A:
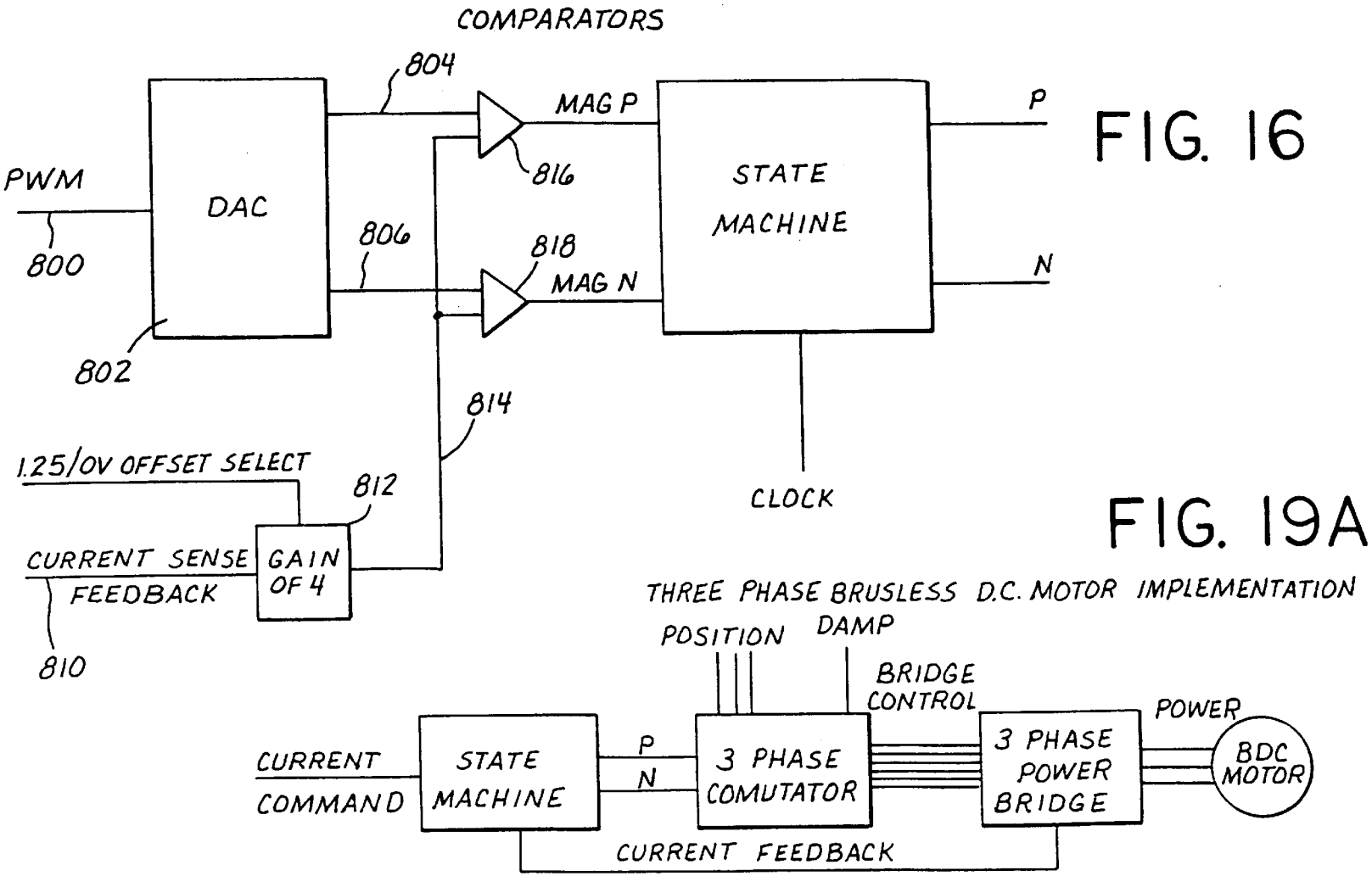
FIG. 16 shows the state machine with the input signals and the digital to analog convertor for providing the signals.
FIG. 19A shows the implementation of the balanced buck drive of this invention for a three phase brushless D.C. motor.

The linear circuit shown in FIG. 16 directs the state machine when current demands have been satisfied. The current out of the motor drive bridges such as the bridges shown in FIG. 18 or the implementation of the generalized bridge in FIG. 17 is routed through a single sense resistor. The signal from the sense resistor is level shifted and amplified.

A high speed pulse width module (PWM) signal on line 800 is used as a command signal. This is the signal which is to provide the magnitude MAG-P of the positive pulse (push) or the magnitude MAG-N of the negative pulse (pull). The pulse width module (PWM) signal 800 is received by a digital to analog convertor (DAC) 802 which then provides a signal on lines 804 or 806 to compare the respective magnitude of the positive P signal (push) or the magnitude of the negative N signal MAG-N (pull).

The current sense is provided on line 810 and is amplified by an amplifier, providing a gain of four through amplifier 812. This signal on line 814 is then compared with regard to signals on lines 804 and 806 by comparators 816 and 818. These comparators 816 and 818 then allow for the compared signal which is the MAG-P or MAG-N signal to be given to the state machine of FIG. 15 which is provided by a clock. The output of the state machine is then the P or N output in the form of the MAG-P or MAG-N output as seen in FIG. 15.

Between the output of the state machine as to the P and N signals, an output bridge and the circuitry required to convert the logic signals and the gate drive signals causes the bridges such as the bridges shown in FIGS. 17 and 18 to function for providing power for controlling the motor.

Brush D.C. motors use one controller and two half bridges. The top and bottom of each half bridge are compliments driven directly by the state machine's P and N outputs.

Stepping motors use two controllers and two H bridges. They are configured and controlled like the brush D.C. motors. The brushless D.C. motors use one controller and three half bridges. The P and N signal are fed into a commutator circuit and controlled by a micro-processor or Hall sensors. The commutator compliments the top and bottom of each half bridge. P and N are moved to two of the three half bridges as the motor rotates.

A special case for starting the brushless D.C. motor operates all three half bridges at once. Two half bridges as those of FIG. 18 use the same signal effectively shorting one winding of the motor. Shorting one winding damps initial positioning oscillations at start-up of the motor having the windings shown in FIG. 18.

Figure 19B:
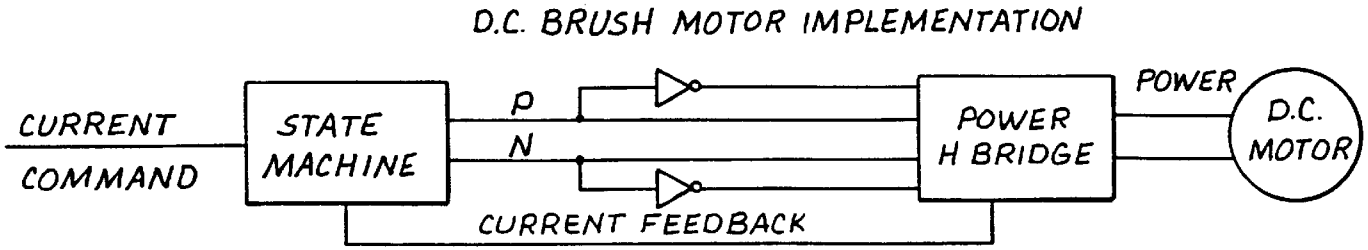
FIG. 19B shows the implementation of the balanced buck drive for a D.C. brush motor.
Figure 19C:
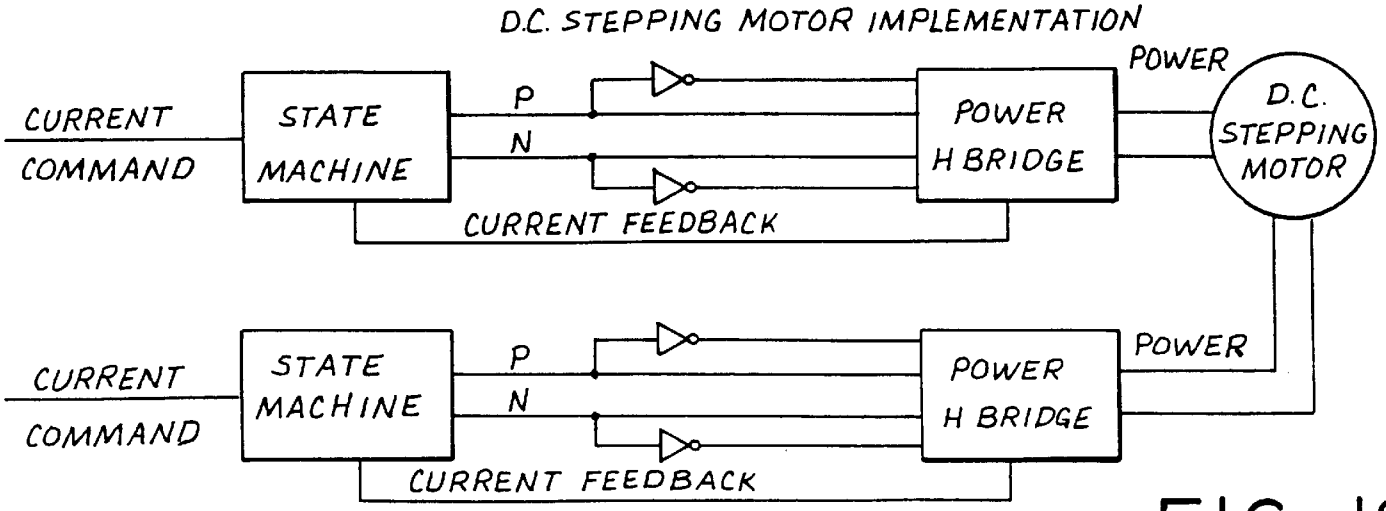
FIG. 19C shows the implementation of the balanced buck drive for a D.C. stepping motor.

Looking more particularly at FIG. 19, it can be seen where the implementation of a three phase brushless D.C. motor has been shown (B D.C. motor); a D.C. brush motor implementation (D.C. motor); and, a D.C. stepping motor (D.C. stepping motor) have been shown.

When implementing the three phase brushless D.C. motor as shown in the top portion of FIG. 19, it can be seen that a command from a processor or DAC 802 is provided to the state machine. The signal from the DAC is one that has been compared and then provided by the comparator. The output from the state machine, namely output P or N for the push P or respective pull N functions, is then provided to a three phase commutator. The commutator applies the P or N signals to the correct half bridges and coil of the motor as directed by the position and damp inputs. These inputs can come from a processor or can be derived from sensors such as Hall effect sensors. Power is then delivered to the brushless D.C. motor to the respective coil. Current feedback is provided back to the state machine in the manner as previously stated.

The D.C. brush motor implementation (D.C. motor) also provides for the output from the processor or the DAC. This is provided to the state machine so that an output P or N is then placed on the respective lines P and N and then inverted so that the inversion would respectively be on the top to the bottom upper and lower bridge inputs for the P line and upper lower inputs for the N line or the opposite for each one respectively. The power H bridge then provides for the current feedback to the state machine for the particular coil of the D.C. motor. The brush D.C. motor uses internal mechanical commutation to select the correct coil. In effect, the D.C. motor is only looking at one coil at each time power is being applied, the state machine output need not be commutated as in the B D.C. motor implementation.

The D.C. stepping motor requires individual control of each coil circuit for proper operation. The D.C. stepping motor implementation because of the fact there are two coils requires two state machines. The two respective state machines function in the same manner as the D.C. motor implementation for each respective coil. In effect, one coil requires P and N signals with the respective upper and lower portions for the P (push) signal and the N (pull) signal to the power H bridge. The power to the particular coil is then provided to the D.C. stepping motor. As to which coil, since there must be two state machines, two power H bridges, and two inputs respectively, is a matter of control from the processor and a DAC connected to the state machine respectively for each coil of the D.C. stepping motor.

From the foregoing specification it can be seen that this invention has application for the control of the drive of motors for all types of printers as well as the line printer of this invention. Furthermore, it has application with regard to various motors including three phase brushless D.C. motors, D.C. brush motors, and D.C. stepping motors. Consequently, it is believed that this invention should be given broad coverage with respect to the following claims.

I claim:

1. A dot matrix printer comprising:

a plurality of hammers forming in part a hammerbank;

motor means having coil means, for driving said hammerbank;

means for releasing said hammers for printing on a print media;

a counterbalance mechanically linked to said hammerbank;

means for linking the position of said motor to the position of said hammerbank;

a state machine for controlling the driving of said coil means positively, and then negatively after current in the coil means has partially decayed during current decay; and, means for allowing the current in the coil means to further decay after negatively driving said coil means until positively driving the coil means.

2. The printer as claimed in claim 1 further comprising:

means for driving current through one of said coil means of the motor means while shorting the remaining coil means for initial open loop mode driving of the motor.

3. The printer as claimed in claim 1 further comprising:

means for driving the motor means in a closed loop mode after driving the motor means in an open loop mode.

4. A dot matrix printer as claimed in claim 1 wherein:

said state machine controls the current to said coil means positively from an initial reference point, then allows said current to decay to an intermediate reference point, then applys a negative current to said coil means to a second intermediate reference point and, then allows the current in said coil means to subsequently decay to the initial reference point.

5. The dot matrix printer as claimed in claim 4 further comprising:

H bridge means having a plurality of transistors connected to said coil means; and, capacitor means connected between the gate of said transistor and said coils.

6. The dot matrix printer as claimed in claim 1 further comprising:

signal means derived from a digital to analog convertor and comparators to provide said state machine with a magnitude of the positive or negative currents respectively for driving said motor means.

7. A method for driving a line printer having a plurality of hammers on a hammerbank for printing on an underlying media comprising:

providing a motor with multiple coils connected to said hammerbank for movement of said hammerbank in response to said motor;

providing a state machine to control the current in said coils;

driving one of said coils with a current at startup of the motor;

rotating said motor to a known position;

driving the motor through a subsequent coil;

detecting the position of the motor while at the same time linking the position of the motor to the position of the hammerbank;

energizing said coils for initially driving them positively from a reference level to an upper reference level;

allowing the current in said coils when driven to said upper reference level to decay to an intermediate reference level;

driving said coils negatively from said intermediate reference level; and, allowing the current in said coils to further decay after driving said coil negatively.

8. The method as claimed in claim 7 further comprising:

providing a motor having a stator on the inside and a rotor on the outside;

providing lands and grooves on the rotor;

detecting the differences between lands and grooves in the form of pulses; and, controlling said motor and said hammerbank with respect to said pulses.

9. The method as claimed in claim 8 further comprising:

initially driving said motor in an open loop mode and thereafter in a closed loop mode.

10. A motor for driving a line printer with controls comprising:

a motor having a plurality of coils;

H bridge means having transistors connected to said coils for driving said coils;

control means for turning on said transistors to cause negative and positive flow through the H bridge means connected to said coils;

means for causing positive flow of current from a reference level to an upper reference level through said coils;

means to allow decay of current within said coils from said upper reference level to an intermediate reference level;

means for driving said coils with a negative current from said intermediate reference level to a second intermediate reference level;

means for allowing current within said coils to decay from said second intermediate reference level to the initial reference level; and a state machine for controlling the positive and negative current to said coils.

11. The motor as claimed in claim 10 further comprising;

means for providing a signal indicative of the current level in the coils;

means for comparing the current level in the coils and providing a signal to the state machine for driving the motor coils.

12. The motor as claimed in claim 10 further comprising:

a capacitor between the gate of one of the transistors of the H bridge to the coils; and, means for maintaining a charge on said capacitor by said state machine.

13. A method of driving a dot matrix printer comprising:

providing a plurality of hammers forming in part a hammerbank;

providing means for releasing said hammers for printing on a print media;

counterbalancing said hammerbank by a counterbalance in adjacent parallel relationship with said hammerbank;

providing a motor having coils for driving said hammerbank and said counterbalance;

energizing said coils at an initial reference level with current to an upper reference level;

allowing the current in said coils to decay from said upper reference level to an intermediate reference level;

driving the current negatively in said coils from said intermediate reference level to a second intermediate reference level;

allowing the current in said coils to decay to said initial reference level; and providing a state machine that controls the current to said coils with respect to given reference levels.

14. The method as claimed in claim 13 further comprising:

providing signals as to the value of current in the coils;

comparing the signals of the current in said coils;

providing said comparison to said state machine; and, driving said coils with respect to positive and negative current by the state machine.

15. The method as claimed in claim 13 further comprising:

providing an H bridge having transistors connected to said motor coils;

providing a capacitor between the gates of at least one of said transistors in each leg of said H bridge to said coils; and, providing means to maintain a charge on said capacitors.

16. The method of driving a D.C. motor having a coil comprising:

driving said coil positively at an initial reference level to an upper reference level;

allowing the current in said coil to decay from said upper reference level to a first intermediate reference level;

driving said coil negatively from said first intermediate reference level to a second intermediate reference level;

allowing the current in said coil to decay from said second intermediate reference level to a lower reference level; and, controlling the positive and negative current to said coil by a state machine.

17. The method as claimed in claim 16 further comprising:

providing a signal as to the current in said coil;

comparing said current to a reference level; and, providing said comparison to said state machine.

18. The method as claimed in claim 17 further comprising:

providing an H bridge for driving said coil having transistors;

driving said coil by conducting current from one transistor of the bridge to a second transistor of the bridge;

providing a capacitor between the gate of a transistor of one of the bridges and said coil; and, maintaining a charge on said capacitor.

* * * * *